US007549625B2

(12) United States Patent
Gotoh

(10) Patent No.: US 7,549,625 B2
(45) Date of Patent: Jun. 23, 2009

(54) PAPER FEED APPARATUS HAVING A MOUNTED PICK-UP UNIT AND IMAGE FORMATION APPARATUS HAVING THE SAME

(75) Inventor: Kazuhiro Gotoh, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 36 days.

(21) Appl. No.: 11/354,926

(22) Filed: Feb. 16, 2006

(65) Prior Publication Data

US 2007/0018381 A1 Jan. 25, 2007

(30) Foreign Application Priority Data

Jul. 25, 2005 (JP) ..... 2005-215069

(51) Int. Cl.
*B65H 3/44* (2006.01)

(52) U.S. Cl. ..... 271/9.13; 271/9.07; 271/9.08; 271/9.09; 271/162; 399/392; 399/393; 399/124

(58) Field of Classification Search ..... 271/9.07, 271/9.08, 9.09, 9.13, 162, 164, 242; 399/288, 399/391, 392, 393, 394, 124
See application file for complete search history.

(56) References Cited

U.S. PATENT DOCUMENTS

| | | | | |
|---|---|---|---|---|
| 5,132,742 | A * | 7/1992 | Goto | 399/401 |
| 5,897,244 | A * | 4/1999 | Miyazaki et al. | 399/122 |
| 6,134,404 | A * | 10/2000 | Iwai et al. | 399/110 |
| 6,546,228 | B2 * | 4/2003 | Motohashi et al. | 399/401 |
| 6,788,910 | B2 * | 9/2004 | Kida | 399/124 |
| 6,873,822 | B2 * | 3/2005 | Tomono et al. | 399/401 |
| 6,889,031 | B2 * | 5/2005 | Tsuchida | 399/401 |
| 6,955,349 | B2 * | 10/2005 | Watase | 271/242 |
| 7,156,389 | B2 * | 1/2007 | Kadowaki et al. | 271/118 |
| 2002/0060389 | A1 * | 5/2002 | Sugimura | 271/9.11 |
| 2006/0188305 | A1 * | 8/2006 | Murrell et al. | 399/388 |
| 2006/0192331 | A1 * | 8/2006 | Nakashima et al. | 271/126 |
| 2006/0214353 | A1 * | 9/2006 | Carter et al. | 271/9.09 |
| 2006/0226595 | A1 * | 10/2006 | Yamamoto et al. | 271/162 |
| 2007/0077088 | A1 * | 4/2007 | Shiraishi et al. | 399/124 |

FOREIGN PATENT DOCUMENTS

| | | | |
|---|---|---|---|
| JP | 11-322117 A | | 11/1999 |
| JP | 11322117 A | * | 11/1999 |
| JP | 2001-225973 A | | 8/2001 |

* cited by examiner

*Primary Examiner*—Patrick H Mackey
*Assistant Examiner*—Gerald W McClain
(74) *Attorney, Agent, or Firm*—Sughrue Mion, PLLC

(57) ABSTRACT

A paper feed apparatus includes a paper cassette, a registration roller pair, a first feed roller, and a second feed roller. In the paper feed apparatus, a pick-up unit is provided which is mounted to an image formation apparatus main body, and which has the registration roller pair, the first feed roller; a first guide part constituting a paper feeding path ranging from the first feed roller to the registration roller pair; a second guide part constituting a paper feeding path ranging from the second feed roller to the registration roller pair; and a paper feed base part that holds the registration roller pair, the first feed roller, the first guide part, the second feed roller, and the second guide part on the roller both end sides, respectively, for unitization.

20 Claims, 7 Drawing Sheets

PAPER FEED APPARATUS HAVING A MOUNTED PICK-UP UNIT AND IMAGE FORMATION APPARATUS HAVING THE SAME

CROSS-REFERENCE TO RELATED APPLICATION

This application claims priority under 35 USC 119 from Japanese Patent Application No. 2005-215069, the disclosure of which is incorporated by reference herein.

BACKGROUND OF THE INVENTION

1. Field of the Invention

The present invention relates to a paper feed apparatus for feeding a paper, and an image formation apparatus having the same.

2. Description of the Related Art

Image formation apparatuses, such as copying machines, printers, and the like, are widely used. In recent years, for these image formation apparatuses, various contrivances have been made in order to give a configuration which renders them conveniently usable.

For example, in Japanese Patent Laid-Open Publication (JP-A) No. 2001-225973 and Japanese Patent Laid-Open Publication No. 11-322117, a paper feed apparatus which covers a range from a feed roller pair in the downstream part of a paper pick-up/feeding apparatus to a registration roller pair in the upstream part of a transfer apparatus is provided. This paper feed apparatus includes a pick-up unit with which a member constituting the paper feeding path ranging over both roller pairs, and a registration roller pair are unitized into a paper feed base, and further paper feed means for manual paper feed is unitized into the paper feed base; and this pick-up unit is removably assembled to unit drawing-out means for drawing out the pick-up unit toward the outside of an apparatus main body, and whereby assembling it to the apparatus main body is rendered easy, and jam removal as well as maintenance operation can be performed with ease.

However, the image formation apparatuses as disclosed in Japanese Patent Laid-Open Publication No. 2001-225973 and Japanese Patent Laid-Open Publication No. 11-322117 have a configuration in which the feed rollers and the registration rollers are provided in separate units, thus there has been a problem that the positional accuracy is easily degraded, and leading edge skew adjustment may not be satisfactorily performed.

SUMMARY OF THE INVENTION

The present invention has been made in view of the above circumstances, and provides a paper feed apparatus which allows a high positional accuracy to be maintained, and which can be conveniently used, and an image formation apparatus having the same.

The paper feed apparatus of a first aspect of the present invention provides a paper feed apparatus, including a paper cassette; a registration roller pair which is positioned on the upstream side of a transfer apparatus provided in an image formation apparatus main body; a first feed roller which feeds out paper contained in the paper cassette toward the registration roller pair; and a second feed roller which feeds out a paper disposed in a manual feed tray toward the registration roller pair, wherein a pick-up unit is provided which is mounted to the image formation apparatus main body, having the registration roller pair, the first feed roller; a first guide part constituting a paper feeding path spanning from the first feed roller to the registration roller pair; the second feed roller; a second guide part constituting a paper feeding path spanning from the second feed roller to the registration roller pair; and a paper feed base part which holds the registration roller pair, the first feed roller, the first guide part, the second feed roller, and the second guide part on the roller both end sides, respectively, for unitization.

The paper feed apparatus of a second aspect of the present invention provides an image formation apparatus, including an image formation apparatus main body; a paper cassette; a registration roller pair, which is positioned on the upstream side of a transfer apparatus provided in the image formation apparatus main body; a first feed roller, which feeds out paper contained in the paper cassette toward the registration roller pair; a first guide part constituting a paper feeding path spanning from the first feed roller to the registration roller pair; a second feed roller, which feeds out paper disposed in a manual feed tray toward the registration roller pair; a second guide part constituting a paper feeding path spanning from the second feed roller to the registration roller pair; and a paper feed base part for unitization, which holds at both the roller end sides the registration roller pair, the first feed roller, the first guide part, the second feed roller, and the second guide part respectively, wherein a pick-up unit is also provided, which is mounted to the image formation apparatus main body, and which includes the registration roller pair, the first feed roller, the first guide part, the second feed roller, the second guide part, and the paper feed base part.

BRIEF DESCRIPTION OF THE DRAWINGS

An embodiment of the present invention will be described in detail based on the following figures, wherein.

DETAILED DESCRIPTION OF THE INVENTION

Hereinbelow, an example is given for describing an embodiment of the present invention.

Figure 1:
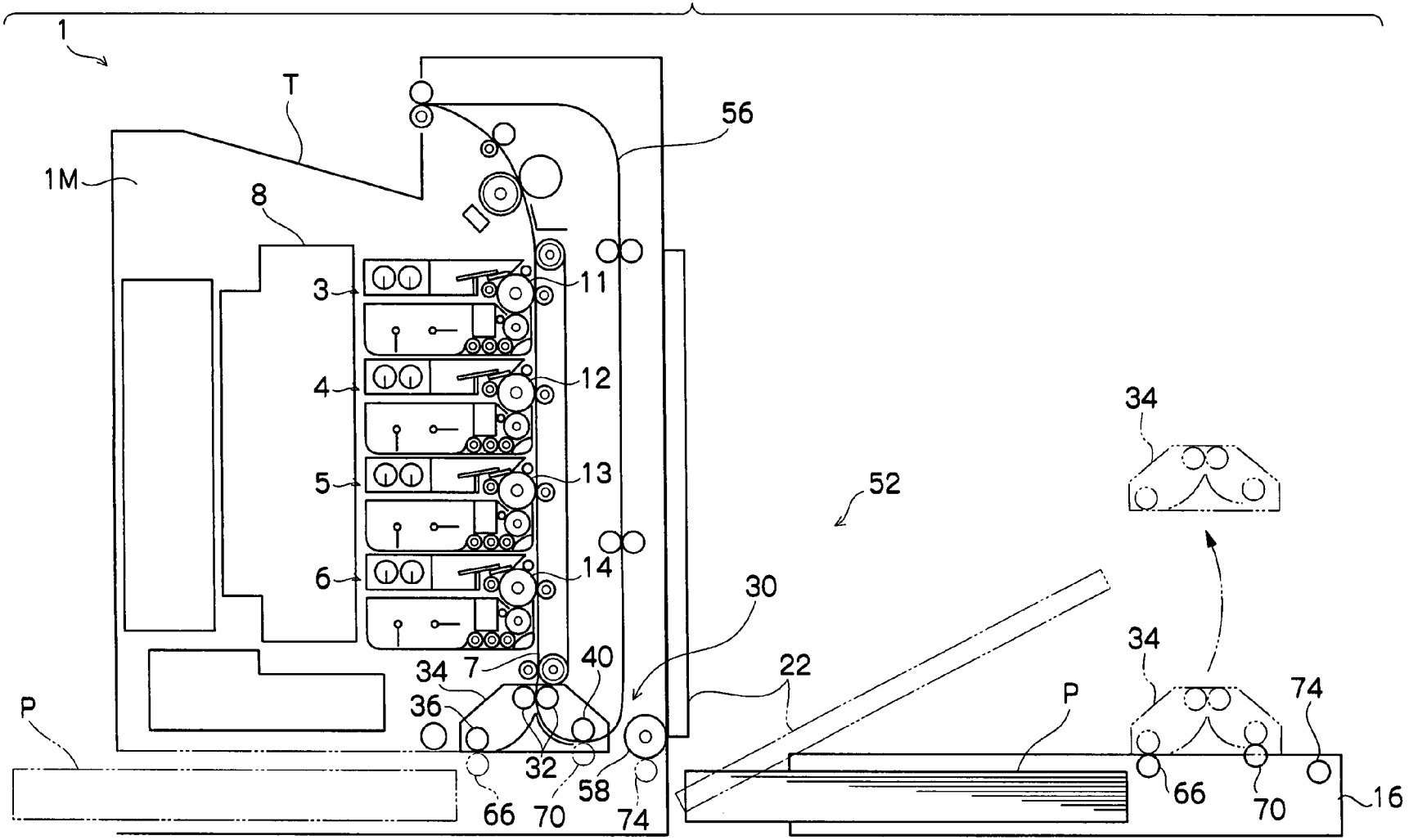
FIG. 1 is a side sectional view illustrating the configuration of a printer pertaining to an embodiment of the present invention.
Figure 2:
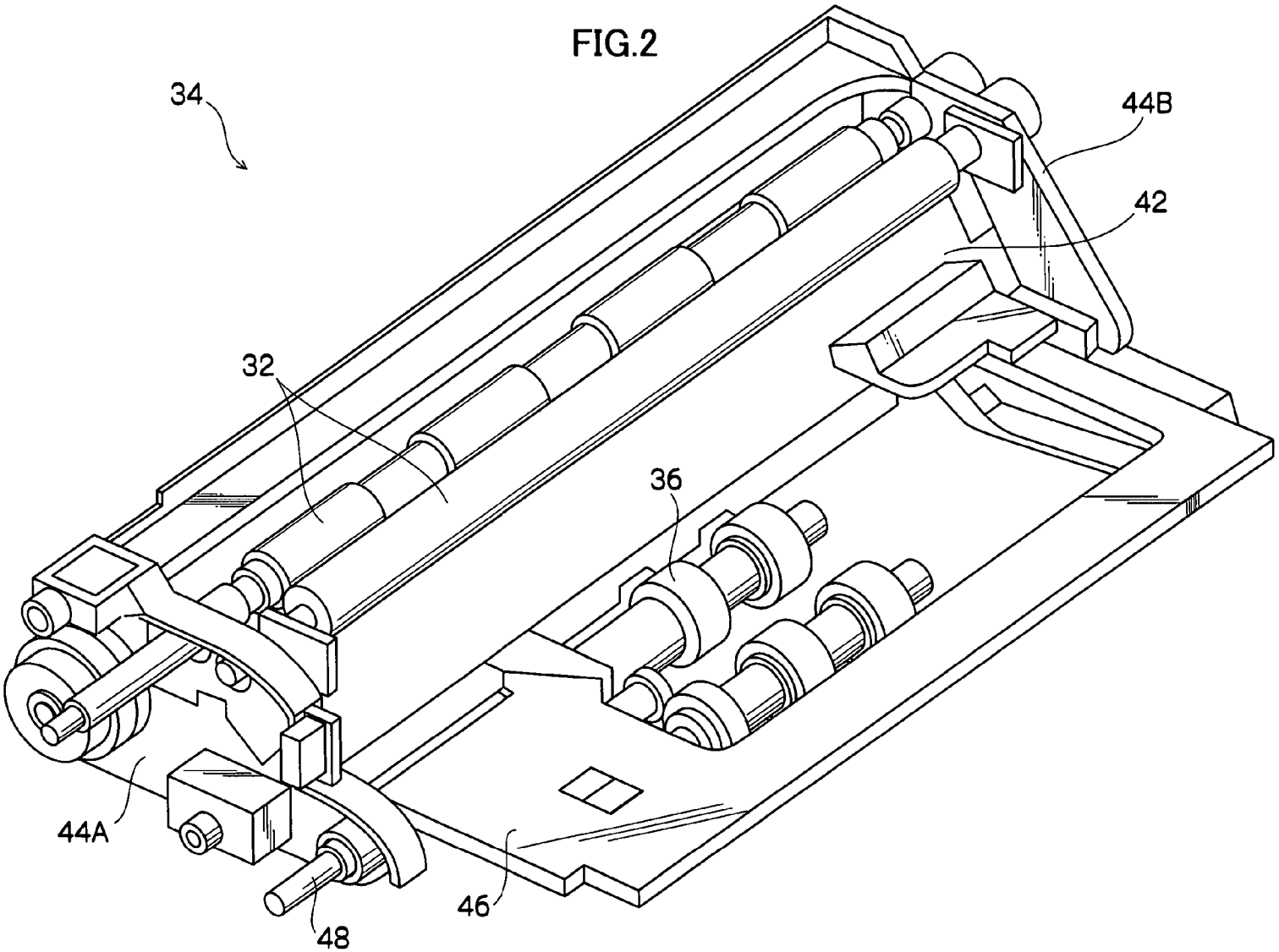
FIG. 2 is a perspective view of a pick-up unit provided in the printer pertaining to the embodiment of the present invention.
Figure 3:
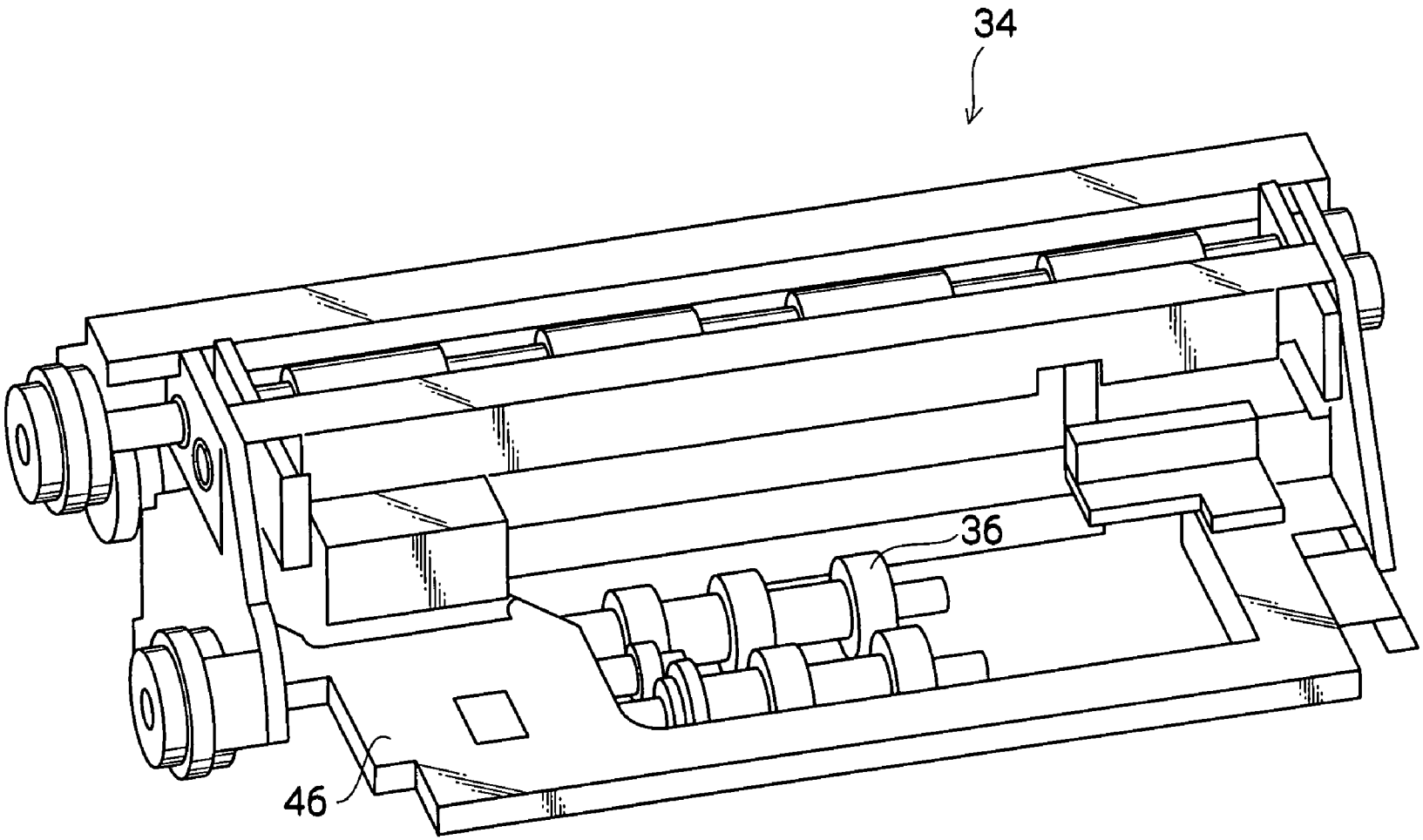
FIG. 3 is a perspective view of the pick-up unit provided in the printer pertaining to the embodiment of the present invention.
Figure 4:
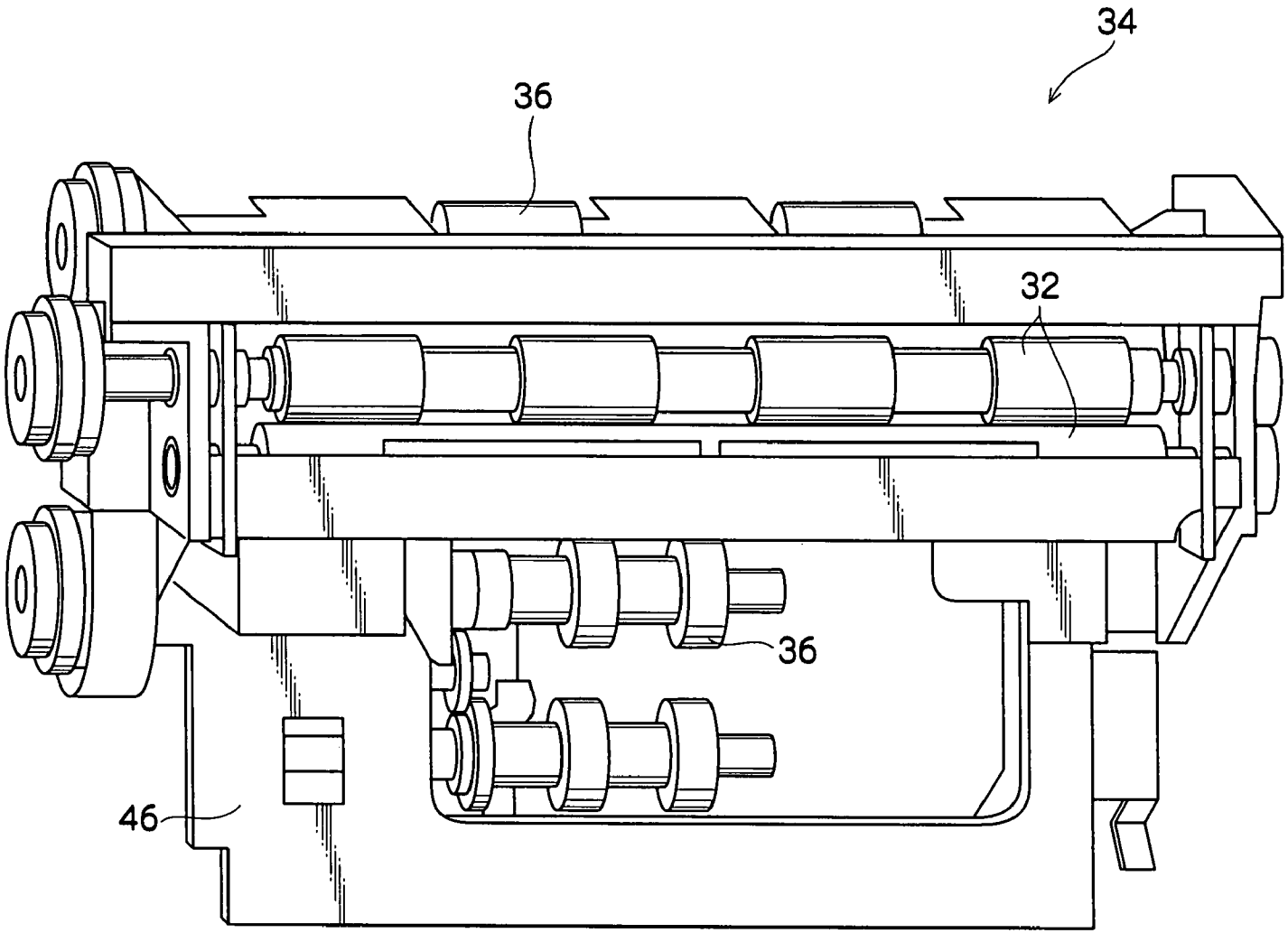
FIG. 4 is a plan view of the pick-up unit provided in the printer pertaining to the embodiment of the present invention.
Figure 5:
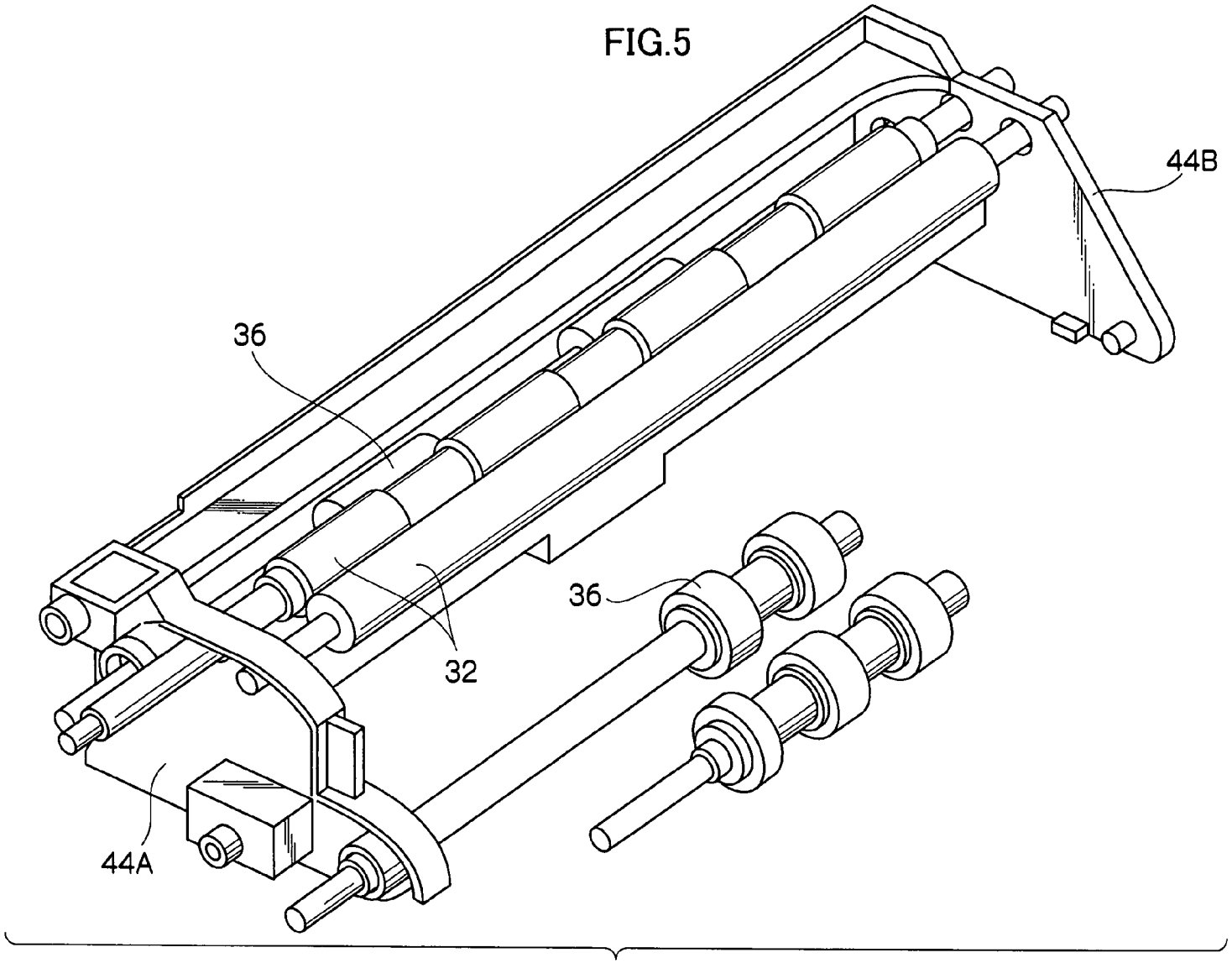
FIG. 5 is a perspective view illustrating the mutual positions among the rollers of the pick-up unit provided in the printer pertaining to the embodiment of the present invention.
Figure 6:
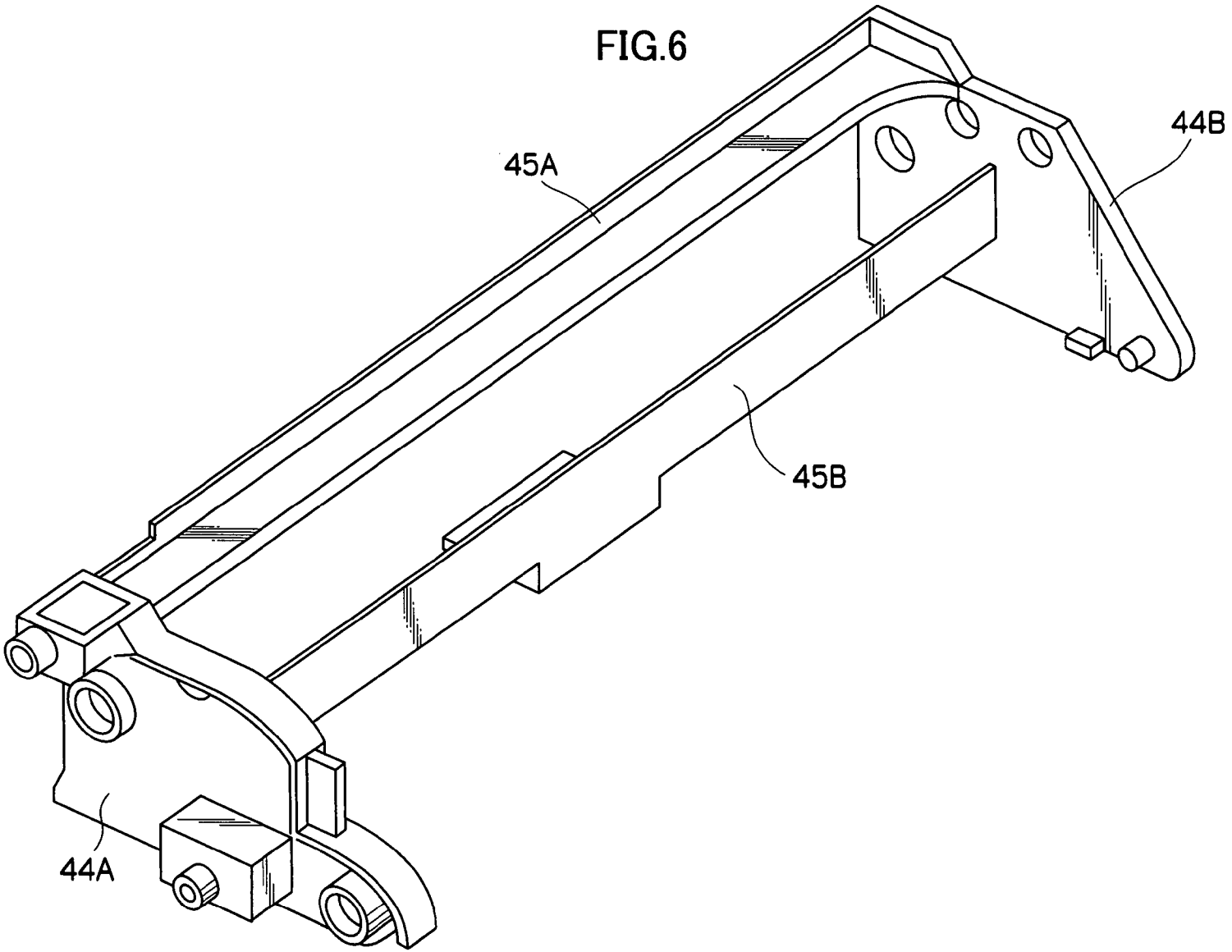
FIG. 6 is a perspective view illustrating the paper feed base part and the connection part of the pick-up unit provided in the printer pertaining to the embodiment of the present invention.
Figure 7:
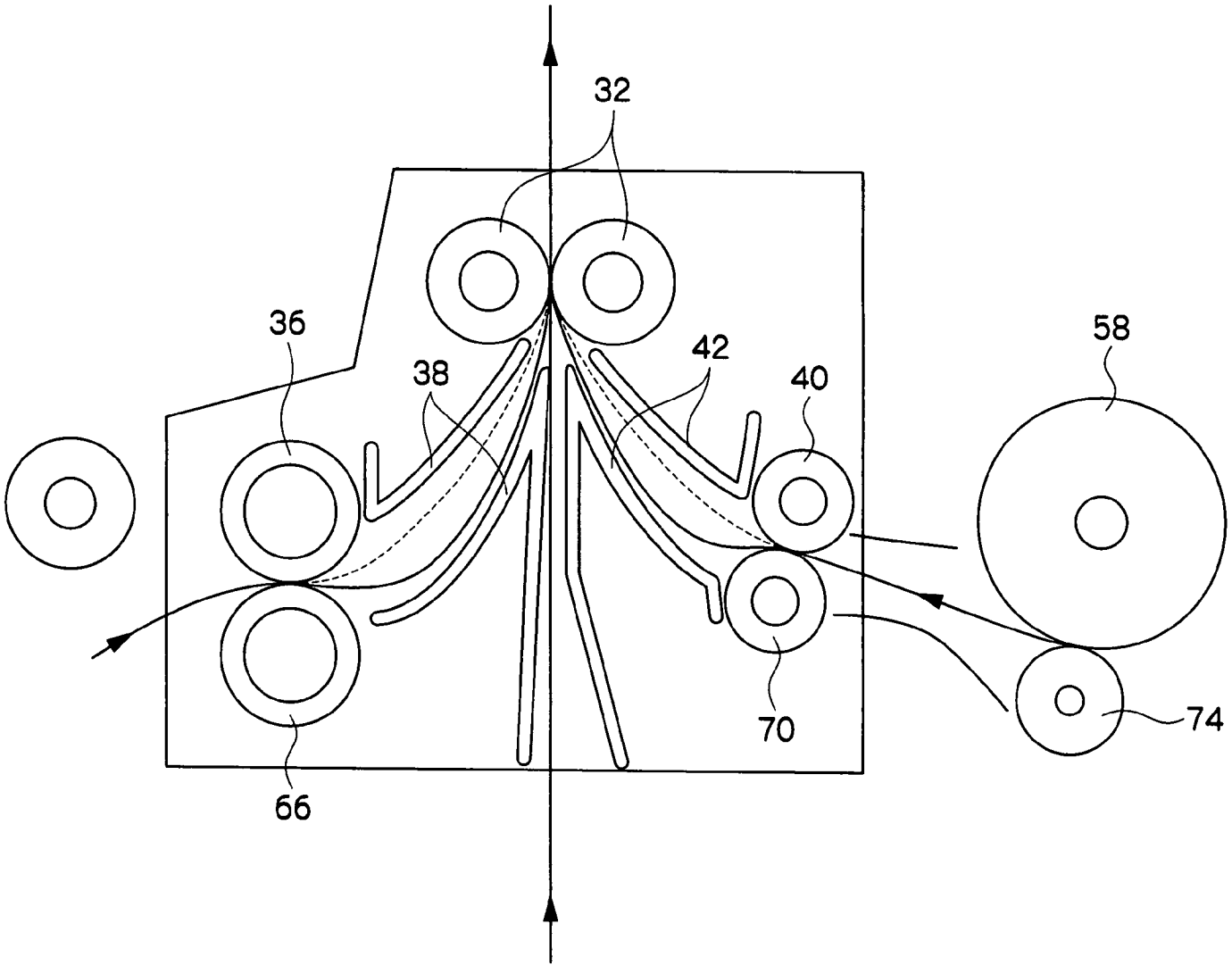
FIG. 7 is a side view illustrating part of the configuration of the printer pertaining to the embodiment of the present invention.

As shown in FIG. 1, a printer 1 pertaining to one embodiment of the present invention is a full color printer. In the printer main body 1M of the printer 1, four process cartridges 3, 4, 5, 6 which are substantially vertically disposed, and a transfer belt 7 which is disposed alongside these process cartridges 3, 4, 5, 6 are provided. From the space provided by opening the transfer belt 7, the process cartridges 3, 4, 5, 6 can be unloaded in substantially the horizontal direction. The process cartridges 3, 4, 5, 6 are provided with photosensitive drums (image carriers) 11, 12, 13, and 14, respectively.

In addition, the printer 1 includes an ROS (Raster Output Scanner) 8 for carrying out image exposure onto the respective photosensitive drums 11, 12, 13, 14. Electrostatic latent images formed on the photosensitive drums 11, 12, 13, 14 are developed with the toners of yellow (Y), magenta (M), black (K), and cyan (C) colors, using the process cartridges 3, 4, 5, 6, respectively. The ROS 8 as an exposure apparatus is composed of: four semiconductor lasers, which are illuminated and driven on the basis of the image data corresponding to the respective colors of yellow (Y), magenta (M), black (K), and cyan (C); fθ lenses and polygon mirrors, or plural reflective mirrors, and the like, for deflecting the four laser beams emitted from these four semiconductor lasers for scanning.

Further, the printer 1 includes a paper cassette 16 for supplying transfer paper P as a transfer material, which is provided under these process cartridges. In the printer main body 1M, a cassette accommodation part is formed for accommodating this paper cassette 16 such that it can be drawn out.

In addition, the printer 1 includes a manual feed tray 22 which can be opened and closed, such that a desired transfer paper P can be fed from the outside of the printer main body 1M.

Besides those elements described above, the printer 1 includes a fixing apparatus (not shown) for carrying out fixing processing of transfer paper P on which a toner image has been transferred; a reversing feed path 56 for double-sided printing for feeding transfer paper P on one side of which an image is fixed by this fixing apparatus, again to a transfer section in the state in which the front and back thereof is reversed; a controller made up of a control circuit for controlling the operation of the printer, an image processing circuit for carrying out image processing for an image signal, and the like; an electric circuit made up of a high-voltage power supply circuit, and the like; and the like. In FIG. 1, a sign of "T" denotes a delivery tray for delivering transfer paper P on which an image has been formed, and this delivery tray T is integrally disposed on the top of the printer main body 1M.

(Paper Feed Mechanism)

In the printer main body 1M, a paper feed mechanism 30 (see FIG. 1) is provided. This paper feed mechanism 30 is provided with a registration roller pair 32, which is positioned on the upstream side of a transfer apparatus provided in the printer main body 1M; and a pick-up unit 34 for feeding out paper contained in the paper cassette 16 toward the registration roller pair 32.

As shown in FIG. 2 to FIG. 7, the pick-up unit 34 includes: the registration roller pair 32; a first feed roller 36; a first guide part 38 constituting a paper feeding path spanning from the first feed roller 36 to the registration roller pair 32; a second feed roller 40 for feeding out paper disposed in the manual feed tray 22 to the registration roller pair 32; and a second guide part 42 constituting a paper feeding path spanning from the second feed roller 40 to the registration roller pair 32. Further, the pick-up unit 34 has a paper feed base part 44A, 44B which holds the registration roller pair 32, the first feed roller 36, the first guide part 38, the second feed roller 40, and the second guide part 42, respectively, on the roller both end sides for unitization.

Because the pick-up unit 34 is thus unitized, loading it on the printer main body 1M will simultaneously establish the positional accuracy from the first feed roller 36 to the registration roller pair 32, and the positional accuracy from the second feed roller 40 to the registration roller pair 32. Therefore, with either of the first feed roller 36 and the second feed roller 40, paper can be fed from the registration roller pair in the state in which leading edge skew adjustment has been adequately carried out.

In addition, the first feed roller 36 and the second feed roller 40 are disposed at a substantially equal distance from the registration roller pair 32. Thereby, the first feed roller 36 and the second feed roller 40 are brought close to each other, and whereby the merits obtained by unitization are further increased.

Further, on the drawing-out side of the paper cassette 16, a manual feed part 52 which allows paper to be fed by manual feed is provided. Thereby, a configuration can be taken in which the manual feed part 52 is disposed with the first feed roller 36 and the second feed roller 40 being brought close to each other, which still further increases the merits obtained by unitization.

In addition, the paper feed base part 44A, 44B is composed of two members provided on the roller both end sides of the registration roller pair 32, the first feed roller 36, the first guide part 38, the second feed roller 40, and the second guide part 42. A connection part 45A, 45B which connects between the paper feed base parts 44A and 44B for reinforcement (see FIG. 6) is provided around the registration roller pair 32 along the axial direction of the registration roller pair 32, and thus the paper feed base part 44A, 44B and the connection part 45A, 45B compose a frame element. Thereby, the frame rigidity around the registration roller pair 32 is improved, and thus even if the pressing force of the registration rollers is high, a high positional accuracy can be maintained. In addition, the frame configuration around the registration roller pair 32 can be easily simplified.

Further, as described above, in the printer main body 1M, the reversing feed path 56 for double-sided printing is provided, and the second feed roller 40 is provided such that paper which has been fed from the reversing feed path 56 can be fed out to the registration roller pair 32. Thereby, also for paper from the reversing feed path 56, the leading edge skew adjustment can be adequately carried out.

In addition, in the printer main body 1M, a unit drawing-out mechanism for drawing out the pick-up unit 34 toward the outside of the apparatus main body is provided. As shown in FIG. 1, the pick-up unit 34 may be removably mounted to the unit drawing-out mechanism, whereby maintenance of the pick-up unit 34, and jam removal are facilitated.

Further, the manual feed part 52 is provided with a manual feed roller 58 for feeding paper fed by manual feed toward the second feed roller 40. As shown in FIG. 1, the paper cassette 16 has a first opposing roller 66 disposed so as to face the first feed roller 36, a second opposing roller 70 disposed so as to face the second feed roller 40, and a third opposing roller 74 disposed so as to face the manual feed roller 58. The paper cassette 16 is provided so as to be taken out to the outside of the printer main body 1M. Thereby, simply by drawing out the paper cassette 16, the rollers facing the first feed roller 36, the second feed roller 40, and the manual feed roller 58, and the like, can be drawn out, which facilitates jam removal in the nip part.

Hereinabove, by giving an example, the embodiment of the present invention has been described. However, the embodiment as described above is illustrative only, and the present invention can be embodied in various forms within the spirit and scope thereof. In addition, needless to say, the scope of the rights of the present invention is not limited to the embodiment as described above.

In the present specification, the term "paper" is a generic which covers not only a piece of paper, but also anything that can be fed from the paper cassette and can be printed, such as OHP paper, or the like.

The paper feed apparatus of the present invention is provided with a unitized pick-up unit, and thus the positional accuracy from the first feed roller to the registration roller pair, and the positional accuracy from the second feed roller to the registration roller pair are simultaneously established. Therefore, a paper feed apparatus can be realized with which, in the state in which the leading edge skew adjustment has been adequately carried out, either of the first feed roller and the second feed roller can feed paper from the registration roller pair to a transfer section, and which allows a high positional accuracy to be maintained and is convenient to use.

In the present invention, the first feed roller and the second feed roller may be disposed at a substantially equal distance from the registration roller pair.

The wording "substantially equal" means that the respective feed rollers are disposed such that, even if the control pattern for leading edge skew adjustment by the registration rollers is not changed, a length of the paper feeding path is provided with which the leading edge skew adjustment is carried out.

By the configuration as described above, the first feed roller and the second feed roller are brought close to each other, and thus the merits obtained by unitization are still further increased.

In the present invention, on the drawing-out side of the paper cassette, a manual feed part which allows paper to be fed by manual feed can be provided.

Thereby, a configuration can be taken in which the manual feed part is disposed with the first feed roller and the second feed roller being brought close to each other, which increases the merits obtained by the unitization.

In the present invention, the paper feed base part may be composed of two members, provided on both the roller end sides of the registration roller pair, the first feed roller, the first guide part, the second feed roller, and the second guide part. Further, a connection part which connects between the paper feed base parts for reinforcement may be provided around the registration roller pair along the axial direction of the registration roller pair.

Thereby, the frame rigidity around the registration roller pair is improved, and thus even if the pressing force of the registration rollers is large, a high positional accuracy can be maintained. In addition, the frame configuration around the registration roller pair can be easily simplified.

In the present invention, the image formation apparatus main body may be provided with a reversing feed path for double-sided printing, and the second feed roller may be provided such that paper fed from the reversing feed path is capable of being fed out to the registration roller pair.

Thereby, also for paper from the reversing feed path, the leading edge skew adjustment can be adequately carried out.

In the present invention, the image formation apparatus main body may be provided with a unit drawing-out part for drawing out the pick-up unit to the outside of the apparatus main body, and the pick-up unit may be removably mounted to the unit drawing-out part.

Thereby, maintenance of the pick-up unit, and jam removal are facilitated.

In the present invention, the manual feed part may be provided with a manual feed roller for feeding paper fed by manual feed toward the second feed roller, and may include an opposing unit which is provided so as to be taken out tow the outside of the image formation apparatus main body, having a first opposing member disposed so as to face the first feed roller, a second opposing member disposed so as to face the second feed roller, and a third opposing member disposed so as to face the manual feed roller.

Thereby, the members (such as rollers, pads, and the like) facing the first feed roller, the second feed roller, and the manual feed roller can be drawn out, whereby jam removal in the nip part is facilitated.

In the present invention, the opposing unit may be the paper cassette.

Thereby, simply by drawing out the paper cassette, jam removal in the nip part can be carried out.

In the present invention, any of the first opposing member, the second opposing member, and/or the third opposing member may be composed of a roller.

Thereby, the paper is easily fed, and the paper cassette is easily drawn out.

In the present invention, the image formation apparatus may have any of the paper feed apparatuses as described above.

Thereby, the image formation apparatus can feed paper satisfactorily, and is convenient to use.

According to the present invention, a paper feed apparatus which allows a high positional accuracy to be maintained and which is convenient to use, and an image formation apparatus including the same can be realized.

What is claimed is:

1. A paper feed apparatus comprising:

a paper cassette;

a registration roller pair, which is positioned on the upstream side of a transfer apparatus provided in an image formation apparatus main body;

a first feed roller, which is positioned to form a nip with an adjacent feed element, the nip being the first nip to engage paper fed from the paper cassette toward the registration roller pair;

a first guide part constituting a paper feeding path spanning from the first feed roller to the registration roller pair;

a second feed roller, which feeds out paper disposed in a manual feed tray toward the registration roller pair;

a second guide part constituting a paper feeding path spanning from the second feed roller to the registration roller pair; and a paper feed base part, which holds together the registration roller pair, the first feed roller, the first guide part, the second feed roller, and the second guide part as a unit such that they move together from a first position to a second position with the paper feed base part, wherein a pick-up unit is mounted to the image formation apparatus main body, and comprises the registration roller pair, the first feed roller, the first guide part, the second feed roller, the second guide part, and the paper feed base part.

2. The paper feed apparatus of claim 1, wherein the first feed roller and the second feed roller are disposed at a substantially equal distance from the registration roller pair.

3. The paper feed apparatus of claim 1, wherein a manual feed part, which allows paper to be fed by manual feed, is provided at a drawing-out side of the paper cassette.

4. The paper feed apparatus of claim 3, wherein the manual feed part is provided with a manual feed roller for feeding paper fed by manual feed toward the second feed roller, and the paper feed apparatus further comprises an opposing unit, which is provided so as to be capable of being taken out to outside of the image formation apparatus main body, and which has a first opposing member disposed so as to face the first feed roller, a second opposing member disposed so as to face the second feed roller, and a third opposing member disposed so as to face the manual feed roller.

5. The paper feed apparatus of claim 4, wherein the opposing unit includes the paper cassette.

6. The paper feed apparatus of claim 5, wherein each of the first opposing member, the second opposing member, and the third opposing member includes a roller.

7. The paper feed apparatus of claim 1, wherein the paper feed base part comprises two members, provided one at each of the roller end sides of the registration roller pair, the first feed roller, the first guide part, the second feed roller, and the second guide part; and a connection part, which connects between and reinforces the two members and is provided at a periphery of the registration roller pair along the axial direction of the registration roller pair.

8. The paper feed apparatus of claim 1, wherein, in the image formation apparatus main body, a reversing feed path for double-sided printing is provided, and the second feed roller is provided such that paper fed from the reversing feed path is capable of being fed out to the registration roller pair.

9. The paper feed apparatus of claim 1, wherein, in the image formation apparatus main body, a unit drawing-out part for drawing out the pick-up unit toward an outside of the image forming apparatus main body is provided, and the pick-up unit is removably mounted to the unit drawing-out part.

10. An image formation apparatus comprising:

an image formation apparatus main body;

a paper cassette;

a registration roller pair, which is positioned on the upstream side of a transfer apparatus provided in the image formation apparatus main body;

a first feed roller, which is positioned to form a nip with an adjacent feed element, the nip being the first nip to engage paper fed from the paper cassette toward the registration roller pair;

a first guide part constituting a paper feeding path spanning from the first feed roller to the registration roller pair;

a second feed roller, which feeds out paper disposed in a manual feed tray toward the registration roller pair;

a second guide part constituting a paper feeding path spanning from the second feed roller to the registration roller pair; and a paper feed base part, which holds together the registration roller pair, the first feed roller, the first guide part, the second feed roller, and the second guide part as a unit, wherein a pick-up unit is mounted to the image formation apparatus main body, and comprises the registration roller pair, the first feed roller, the first guide part, the second feed roller, the second guide part, and the paper feed base part as a unit such that they move together from a first position to a second position.

11. The image formation apparatus of claim 10, wherein the first feed roller and the second feed roller are disposed at a substantially equal distance from the registration roller pair.

12. The image formation apparatus of claim 10, wherein a manual feed part, which allows paper to be fed by manual feed, is provided at a drawing-out side of the paper cassette.

13. The image formation apparatus of claim 12, wherein the manual feed part is provided with a manual feed roller for feeding paper fed by manual feed toward the second feed roller, and the paper feed apparatus further comprises an opposing unit which is provided so as to be capable of being taken out to outside of the image formation apparatus main body, and which has a first opposing member disposed so as to face the first feed roller, a second opposing member disposed so as to face the second feed roller, and a third opposing member disposed so as to face the manual feed roller.

14. The image formation apparatus of claim 13, wherein the opposing unit includes the paper cassette.

15. The image formation apparatus of claim 14, wherein each of the first opposing member, the second opposing member, and the third opposing member includes a roller.

16. The image formation apparatus of claim 10, wherein the paper feed base part comprises two members, provided one at each of the roller end sides of the registration roller pair, the first feed roller, the first guide part, the second feed roller, and the second guide part; and a connection part which connects between and reinforces the two members and is provided at a periphery of the registration roller pair along the axial direction of the registration roller pair.

17. The image formation apparatus of claim 10, wherein, in the image formation apparatus main body, a reversing feed path for double-sided printing is provided, and the second feed roller is provided such that paper fed from the reversing feed path is capable of being fed out to the registration roller pair.

18. The image formation apparatus of claim 10, wherein, in the image formation apparatus main body, a unit drawing-out part for drawing out the pick-up unit toward an outside of the image forming apparatus main body is provided, and the pick-up unit is removably mounted to the unit drawing-out part.

19. The paper feed apparatus of claim 1, wherein the paper feed base part holds ends of the registration roller pair, the first feed roller, the first guide part, the second feed roller, and the second guide part.

20. The image formation apparatus of claim 10, wherein the paper feed base part holds ends of the registration roller pair, the first feed roller, the first guide part, the second feed roller, and the second guide part.

* * * * *